United States Patent [19]

Dalton, Jr. et al.

[11] 4,313,806

[45] Feb. 2, 1982

[54] CATHODIC PROTECTION OF CATALYSTS IN A CORROSIVE ENVIRONMENT

[75] Inventors: Augustine I. Dalton, Jr.; Ronald W. Skinner, both of Allentown, Pa.

[73] Assignee: Air Products and Chemicals, Inc., Allentown, Pa.

[21] Appl. No.: 195,815

[22] Filed: Oct. 10, 1980

[51] Int. Cl.[3] ..... C23F 13/00

[52] U.S. Cl. ..... 204/147

[58] Field of Search ..... 204/147

[56] References Cited

U.S. PATENT DOCUMENTS 1,779,436 10/1930 Keitel ..... 204/47

3,201,335 8/1965 MacNab et al. ..... 204/147

3,336,112 8/1967 Hooper ..... 423/584

3,361,533 2/1968 Hooper ..... 423/584

3,972,796 8/1976 Frohler et al. ..... 204/147

*Primary Examiner*—R. L. Andrews

*Attorney, Agent, or Firm*—E. Eugene Innis; James C. Simmons

[57] ABSTRACT

Dissolution of Group VIII supported metal catalysts from semi-conductive or conductive carriers in liquid media containing a strong inorganic acid is stopped by making the Group VIII noble metal cathodic with respect to an anode placed in the reactor. A representative embodiment is in processes for synthesis of hydrogen peroxide from its elements.

8 Claims, 2 Drawing Figures

CATHODIC PROTECTION OF CATALYSTS IN A CORROSIVE ENVIRONMENT

BACKGROUND OF THE INVENTION

1. Field of the Invention

This invention relates to a method for preventing dissolution of Group VIII supported noble metal catalysts in acidic environments.

2. Prior Art

An undesirable side effect in many liquid phase catalytic syntheses employing a supported catalyst of a Group VIII noble metal is that the noble metals tend to dissolve when in media which are "corrosive," that is, provide an oxidizing environment. Corrosive media or environments include liquids which contain an oxidizing acid, particularly those containing HCl, $H_2SO_4$ and/or $HNO_3$, even in very low concentrations. Liquid media subjected to treatment with oxygen and containing any acid are corrosive, as are those containing any acid plus $H_2O_2$ or any other oxidizing agent.

The corrosion or dissolution reaction can be represented by the equation $$M \rightleftarrows M^{N+} + ne^-$$

in which M is a Group VIII noble metal which is oxidized to an N+ valence state with loss of n electrons. The reverse reaction represents reduction of the soluble noble metal compound to the metal.

Typical of processes in which losses by solubilization of Group VIII noble metals from supported catalysts become especially troublesome are liquid phase catalytic processes for producing hydrogen peroxide from its elements, employing supported precious metal catalysts, e.g., from Groups I or VIII of the Periodic Table, as proposed by Hooper in U.S. Pat. Nos. 3,336,112 and 3,361,533, herein incorporated by reference. The liquid media described in these references contain a non-acidic oxygenated organic compound and at least one strong acid, e.g., $H_2SO_4$, $HNO_3$, HF, HCl, HBr, $H_3PO_4$ or sulfonic acids, in concentrations ranging from 0.01 N to 2 N.

In this type of synthesis, the combination of hydrogen peroxide and/or oxygen and one or more strong acids, particularly hydrochloric acid required to attain reasonable levels of hydrogen peroxide, provides an oxidatively active environment which leads to serious losses of palladium or other catalytic metals by dissolution.

In a representative case, deactivation of palladium on carbon catalyst used in batch synthesis of hydrogen peroxide from its elements appears to reach a maximum after about 3 hours' reaction. The apparent decline in soluble palladium as a function of time is attributed to the redeposition and/or readsorption of palladium on carbon. It will be understood that loss of Group VIII metal from the catalyst owing to mechanical attrition will also occur.

In a typical continuous process for the synthesis of hydrogen peroxide, employing a bed of palladium on carbon catalyst, the cumulative loss of palladium was 16% after 185 hours of operation.

Loss of palladium or other Group VIII noble metals is an economically unacceptable occurrence due to (1) the loss of expensive palladium, (2) the resultant decrease in catalyst activity from dissolution losses and catalyst deactivation via redeposition of soluble palladium and to (3) the contamination of the product. Although catalyst loss can be reduced somewhat by physical means, no process previously available is capable of stopping the catalyst dissolution reaction.

Cathodic protection has been utilized to prevent or minimize corrosion of marco-continuous metal surfaces, such as bridges, ships or storage tanks, by sea water or other saline media, but had not, prior to the instant invention, been employed to prevent dissolution of Group VIII noble metals from supported catalysts used in oxidizing environments. This technique has been discussed in detail by M. Stern, "Principles of Cathodic Protection," in *Symposium on Corrosion Fundamentals,* A. S. Brasunas et al, editors, University of Tennessee Press, Knoxville (1956). Basically, the concept is based on two observations:

i. Metal corrosion is typically an oxidation process characterized by a reversible equilibrium potential when a corrodible metal is placed in contact with a corrosive medium or electrolyte. In the case of palladium, the potential is −0.620 volts. In a galvanic arrangement, corrosion occurs at the anode.

ii. Each corroding system has a characteristic corrosion potential and current, which are measured by anodic and cathodic polarization curves.

Electroplating of the platinum group metals, specifically of platinum, palladium and rhodium, from ammoniacal media has been disclosed by Keitel et al in U.S. Pat. No. 1,779,436.

SUMMARY OF THE INVENTION

A process for preventing dissolution of Group VIII noble metals or noble metal oxides from conductive or semi-conductive carriers in a corrosive or oxidative environment employed during chemical synthesis comprises polarizing the noble metal surface cathodically with respect to an anode placed within the reaction vessel.

DETAILED DESCRIPTION

Figure 2:
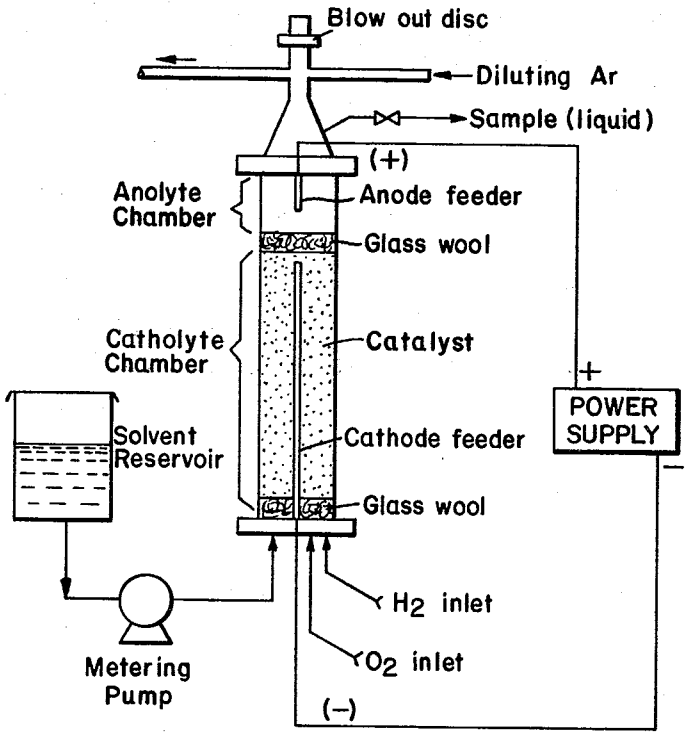
In FIG. 2 is shown a packed bed reactor modified to protect the catalyst bed cathodically.

The equilibrium between dissolution and deposition of palladium in a medium containing chloride ions is represented by the equation $$Pd + 4Cl^- \rightleftarrows PdCl_4^= + 2e^-.$$

Utilization of a galvanic arrangement to polarize the palladium or other noble metal surface (anode) supported on a conductive carrier to render it cathodic with respect to an anode placed in the same solution causes a shift in the equilibrium between the dissolution and deposition reactions to the left, so that the corrosion or forward reaction becomes thermodynamically unfavorable. The effect of cathodic protection is to trade current generated by the corrosion (forward) reaction for an impressed current necessary to cause the reverse (deposition) reaction.

Palladium loss by dissolution, observed during the process for production of hydrogen peroxide in media containing HCl, can be controlled by application of the principles of cathodic protection to the palladium-carbon catalyst bed, which becomes an electrode in galvanic arrangement with a counter-electrode. It is to be understood that the peroxide synthesis is merely representative of processes conducted in corrosive or acidic media, employing Group VIII noble metal catalysts on conductive or semiconductive carriers, in which catalyst dissolution can be stopped by cathodic protection.

An external power supply was used to polarize the catalyst bed. The protecting potential or current could also be generated by use of sacrificial metal counter-electrodes (anodes), with or without an external potential bias.

There appear to be only three limitations on the successful application of the process of the invention, the relative significance of which will vary with each process application:

1. The process must have a liquid phase component, which must be or contain a supporting electrolyte.

2. The catalyst must be more conductive than the liquid phase so that the system will not "short" circuit. In most cases, no problem arises, since only aqueous feeds will typically be very conductive. Even semiconductive supports such as carbon, particularly the more graphitic or semi-crystalline carbons, can be used. The process will work in aqueous streams, provided that the catalyst is sufficiently conductive.

3. The catalyst support must exhibit some degree of conductivity in order to permit a protecting current distribution over the catalyst metal surface. Many of the more traditional catalyst supports, which are essentially nonconductors, such as the zeolites, aluminas, clays, silicas, and silica-alumina, will not be useable in this process. However, these kinds of supports can be rendered semi-conductive by doping or coating techniques, for example, doping silica with germanium as is done in the semi-conductor art in the electronics industry. Alternatively, these low surface area supports can be replaced by porous conductive materials, including nickel and titanium supports.

Application of the principle of cathodic protection to catalyst beds was demonstrated using a palladium on carbon electrode subjected to varying conditions in acidic aqueous acetone. The rate of palladium dissolution was effectively halved by maintaining the palladium-carbon at −100 MV vs SCE.

Cathodic protection of a palladium on carbon catalyst bed of a packed bed reactor used for the synthesis of hydrogen peroxide in acidic aqueous acetone was accomplished maintaining the palladium-carbon bed at +0.5 V. The cathodically protected catalyst bed had a second order palladium corrosion rate at least 35–80 times less than that of an unprotected bed. Observed palladium losses were attributed to physical attrition of the catalyst in the cathodically protected bed, since significant catalyst loss by attrition and mechanical damage normally occurs early in extended runs.

Cathodic protection of palladium-carbon catalyst beds for liquid phase hydrogen peroxide synthesis in an acidic acetone medium generally resulted in losses of palladium so low as to be undetectable, without loss of catalytic activity or decrease in yield of hydrogen peroxide.

Representative oxidative or corrosive media in which the process of this invention may be used include those disclosed by Hooper, supra.

Although the liquid phase can be acidified with a variety of strong inorganic or mineral acids, the process is particularly applicable in liquids containing hydrochloric, nitric and/or sulfuric acid.

"Group VIII noble metal catalyst" as used in the specification and claims, means ruthenium, rhodium, palladium, osmium, iridium, or platinum, that is metals of the palladium and platinum sub-groups of Group VIII of the Periodic Table deposited on a carrier.

"Palladium-group metal" means ruthenium, rhodium or palladium. The process of this invention is preferably applied to preventing dissolution of palladium-group metals from catalysts, most preferably to stopping dissolution of palladium.

The conductive catalyst support is preferably carbon, more particularly, charcoal or activated carbon conventionally used as adsorbents and as catalyst supports.

In a most preferred embodiment, the process of this invention is that wherein the catalyst is palladium supported on carbon and the liquid medium is aqueous acetone, containing a strong acid such as hydrochloric acid or sulfuric acid employed in the synthesis of hydrogen peroxide from its elements.

Without further elaboration, it is believed that one skilled in the art can, using the preceding description utilize the present invention to its fullest extent. The following specific embodiments are, therefore, to be construed as merely illustrative and not limitative of the remainder of the disclosure in any way whatsoever. In the following Examples, the temperatures are set forth uncorrected in degrees Celsius. Unless otherwise indicated, all parts and percentages are by weight.

EXAMPLE 1

Two grams of 5% palladium on carbon were charged to a stirred glass batch reactor containing 275 ml of 75% acetone-25% water by volume which was 0.1 N in sulfuric acid and 0.01 N in hydrochloric acid and contained 100 ppm of each of sodium meta- and pyrophosphates. After cooling to 0° C., hydrogen and oxygen were sparged through the solvent and catalyst at 0.6 scfh and 2.05 scfh, respectively, at a pressure of 126 psig. The reaction mixture was stirred at 1200 rpm. The concentrations of hydrogen peroxide accumulated and dissolved or soluble catalyst were determined as a function of time by titration with standardized potassium permanganate solution and by atomic absorption spectroscopy, respectively.

The following results were obtained:

| Elapsed Time, hrs. | $H_2O_2$ Conc., M | Solubilized Pd | |
|---|---|---|---|
| | | μg/cc | % of charged catalyst |
| 0.25 | 0.282 | 24.48 | 6.73 |
| 0.50 | 0.426 | 23.28 | 6.33 |
| 1.00 | 0.647 | 19.42 | 5.22 |
| 1.50 | 0.855 | 7.22 | 1.90 |
| 2.00 | 0.952 | 5.73 | 1.48 |
| 3.00 | 1.25 | 3.40 | 0.88 |
| 4.00 | 1.25 | 2.76 | 0.70 |

The catalyst had produced 364 moles of hydrogen peroxide/mole of palladium after 3 hours, at which point catalyst deactivation was essentially complete. Extensive dissolution of palladium was the primary cause of catalyst deactivation.

EXAMPLE 2

A continuous reactor for the preparation of hydrogen peroxide from hydrogen and oxygen consisted of a vertical tube packed with palladium on carbon catalyst and equipped for upward cocurrent inflow of hydrogen, oxygen and solvent. Each of the inflow systems was equipped with metering means and a source of hydrogen, oxygen or solvent. The reactor was a pipe 5 feet in length and 1.28 inches in inner diameter, lined with polytetrafluoroethylene and jacketed to permit circulation of a cooling medium. At the top of the reactor, which was equipped with a blowout disc, was a device for removal of liquid samples, means for transferring the reactor effluent to a liquid-gas separator and means for introducing a diluent stream of nitrogen. The gas separated in the liquid-gas separator was vented and the liquid effluent retained. Analyses for hydrogen peroxide and palladium were done as in Example 1.

A. 80% acetone—20% water by volume as solvent.

The reactor was packed with 200 gms of 0.2% palladium on carbon catalyst. A solvent consisting of 80% acetone—20% water, which was 0.05 N in sulfuric acid and 0.0013 N in hydrochloric acid and contained 100 ppm of each of sodium and meta- and pyrophosphates, was passed up through the catalyst bed at the rate of 0.830 l/hr. Hydrogen and oxygen were introduced at 1.7 and 5.1 scfh, respectively. The pressure was 150 psig and the temperature 27°–30° C. After 15 hours, the hydrogen peroxide concentration had reached a steady state concentration of 0.54 molar. The effluent stream contained 0.9 ppm of soluble palladium. At the end of 185 hours of operation, the cummulative loss of palladium was $6\times10^{-4}$ moles (16% of amount charged).

EXAMPLE 3

Figure 1:
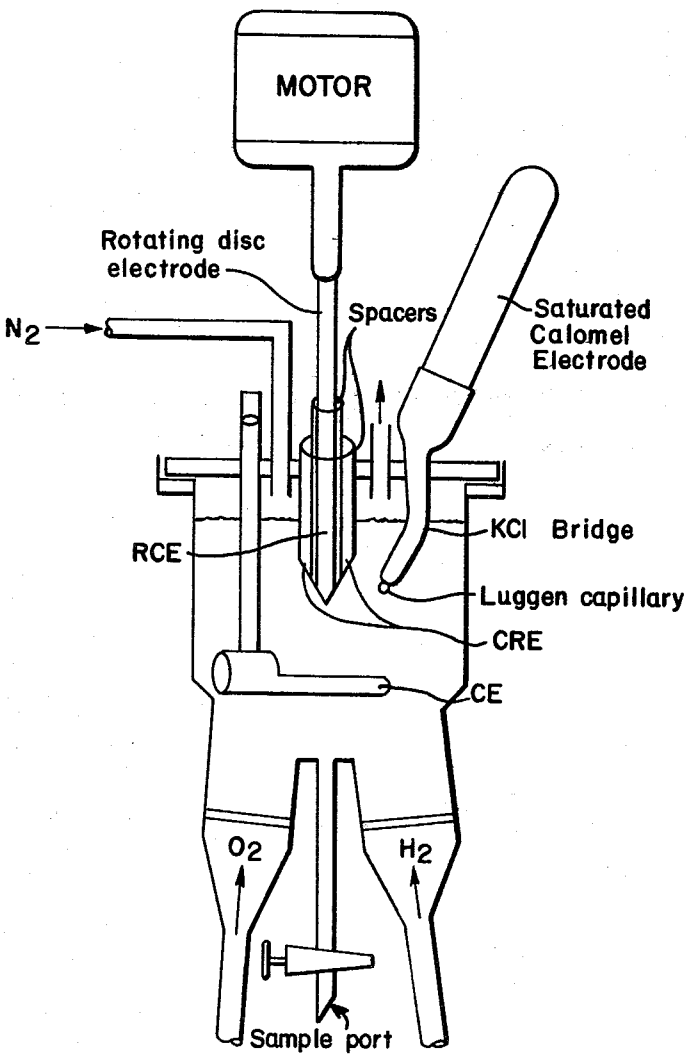
In FIG. 1 is shown an experimental apparatus for applying cathodic protection to a metal deposited on a carbon electrode.

An apparatus in which cathodic protection was used to prevent dissolution of palladium is shown in FIG. 1, in which a rotating disc electrode with a concentric ring was modified to permit sparging with oxygen, hydrogen and nitrogen. In the Figure, RCE means rotating cone electrode, CE means counter electrode and CRE means concentric ring electrode. The inside spacer was made from Teflon and the exterior spacer from Kynar.

To simulate palladium on carbon catalyst, the disc or cone electrode was carbon on which $PdCl_2$ (5 mg) had been deposited and reduced to palladium metal.

The palladium on carbon electrode was subjected to varying conditions in a solvent system consisting of 75:25 acetone:water (by volume) which was 0.1 N in sulfuric acid and 0.01 N in hydrochloric acid to determine extent of palladium dissolution as a function of floating potential. The analytical method was as in Example 1.

As shown in the table below, maintaining the palladium-carbon electrode at −100 MV vs SCE approximately halved the rate of palladium dissolution. Because an imposed current of only 2 MV is required to maintain −400 MV on the palladium-carbon electrode, control of palladium dissolution is entirely feasible.

EXAMPLE 4

The apparatus described in Example 3 was used in a similar series of experiments with a freshly-prepared palladium-carbon electrode and using a 75:25 acetone-water solution which was 1.6 M in $H_2O_2$, 0.01 N in HCl and 0.1 N in $H_2SO_4$. The palladium-carbon electrode was maintained at +0.5 V. Dissolution rates were compared to those observed at floating (no applied) potential and are given in the table below:

| Second Order Rates for Palladium Corrosion $-ds/dt = kS^2$ | | | |
|---|---|---|---|
| Floating Potential | | +0.5 V Potential | |
| Time Interval hrs. | k, $\times 10^{-3}$ | Time Interval hrs. | k, $\times 10^{-3}$ |
| 0–4.05 | 7 | 0–4.33 | 0.195 |
| 4.05–20.25 | 4.5 | 4.33–23.50 | 0.080 |
| 20.25–27.35 | 4.7 | 23.50–28.33 | 0.083 |
| 27.35–45.95 | 4.9 | 28.33–49.08 | 0.063 |

These experiments show that the second order rates for palladium corrosion ($-ds/dt=ks^2$) are decreased markedly by making the palladium-carbon electrode cathodic.

Based on control experiments, palladium loss in experiments with cathodic protection is attributed primarily to physical attrition.

EXAMPLE 5

The apparatus described in Example 3 was fitted out with a fresh Pd/C electrode and used in an experiment to determine the effect of polarization of the catalyst (electrode potential of 0.5 volts) on the decomposition of $H_2O_2$, initially 1.6 M. Hydrogen peroxide concentration was determined by titration with potassium permanganate.

Results were:

| | $H_2O_2$ Concentration, M | |
|---|---|---|
| Time, hrs. | Floating potential | +0.5 V (vs. $H_2$ electrode) |
| 0 | 1.55 | 1.61 |
| 1 | 1.56 | 1.65 |
| 2 | 1.57 | 1.66 |
| 3 | 1.50 | 1.61 |
| 4 | 1.49 | 1.59 |
| 16 | 1.44 | 1.55 |

This experiment shows that polarization of the Pd/C electrode does not increase the rate of peroxide decomposition or impede the inhibition of decomposition attributed to the solvent.

| Run | Temp, °C. | $O_2$ | $H_2$ | $N_2$ | $H_2O_2$, M | Floating Potential vs SCE[b] | Elapsed time, hrs. | Pd(II) ppb | Total Dissolved Pd. μg | % Corroded |
|---|---|---|---|---|---|---|---|---|---|---|
| 1 | 25 | x | | | | floating | 1.3 | 640 | 26 | 0.520 |
| 2 | 27 | x | | | | +390 | 2 | 260 | 10 | 0.200 |
| 3 | 26.2 | x | | | 0.1 | +430 | 2 | 360 | 14 | 0.280 |
| 4 | 18 | x | x | x | | +370 to +220 | 2 | 120 | 5 | 0.100 |
| 5 | 25.5 | | | x | | +330 | 2 | 20 | 0.8 | 0.016 |
| 6 | 25 | x | | | | −100[a] | 2 | 140 | 6 | 0.120 |

[a]Potential is a potentiostatically controlled potential.

[b]In millivolts

EXAMPLE 6

A continuous packed bed reactor similar to that used in Example 2 was modified as shown in FIG. 2. Glass wool was used to separate the anolyte and catholyte chambers. The reactor was further fitted with a counter electrode (anode) and potential source connected to the palladium-carbon catalyst bed, which becomes the cathode.

Synthesis of $H_2O_2$ from $H_2$ and $O_2$ in 75:25 acetone:-water (0.1 N in $H_2SO_4$ and 0.01 N in HCl) was carried out using 0.2% palladium on carbon catalyst under the following conditions, in which Ne and He were used as tracers:

| | |
|---|---|
| solvent flow rate: | 500 ml/hr |
| pressure: | 54–58 psi |
| $O_2$ and Ne mixture (95:5): | 4 scfh |
| $H_2$ and mixture (80.4% $H_2$): | 0.34 scfh |
| Ar (overhead): | 4.05 scfh |
| Temperature | 15° C. |
| $H_2O_2$ addition to feed as indicated | |

An applied potential of 45 V, giving an electrode potential of −200 MV vs SCE, made the catalyst bed (0.2% palladium on carbon, 204 g, packed to a height of 6 inches) cathodic.

As shown by the results obtained, application of potential reduced the level of dissolved palladium in the effluent below the level detectable by atomic absorption spectroscopy.

| Date | Applied Potential | $H_2O_2$ (0.5 M) In Feed Stream | $H_2O_2$ Output, M | Solvent Vol., L | Soluble Pd In Effluent, ppm |
|---|---|---|---|---|---|
| 1/21 | — | — | .035 | 2.5 | 1.6 |
| 1/22 | — | — | — | 1.9 | 1.8 |
| 1/23 | — | — | — | 1.9 | — |
| 1/24 | X | — | .110 | 3.8 | N.D.[a] |
| 1/25 | X | — | .098 | 3.3 | N.D. |
| 1/26 | X | — | .101 | 3.3 | N.D. |
| 1/27–2/7 | X | — | — | 9.1 | —[b] |
| 2/8 | X | — | .047 | 9 | — |
| 2/9 | X | — | .072 | 9 | — |
| 2/10 | X | — | .064 | 9 | — |
| 2/11 | X | — | .056 | 9 | N.D. |
| 2/12–2/13 | X | — | — | 20 | — |

-continued

| Date | Applied Potential | $H_2O_2$ (0.5 M) In Feed Stream | $H_2O_2$ Output, M | Solvent Vol., L | Soluble Pd In Effluent, ppm |
|---|---|---|---|---|---|
| 2/14 | X | X | .232 | 6 | — |
| 2/15 | X | X | .352 | 6 | N.D. |
| 2/16 | X | X | .503 | 6 | — |
| 2/17 | X | X | 0.500 | 6 | N.D. |
| 2/18 | X | X | 0.204 | 6 | — |
| 2/19–2/21 | X | — | — | 30 | — |
| 2/22 | X | — | 0.098 | 9 | N.D. |
| 2/23 | — | X | 0.685 | 9 | 0.5 |
| 2/24 | — | X | 0.707 | 9 | 0.3 |
| 2/25 | — | — | 0.153 | 6 | 0.4 |
| 2/26–2/27 | — | — | — | 21.5 | — |
| 2/28 | — | — | 0.105 | 6 | 0.5 |
| 3/1 | X | — | 0.088 | 9 | — |
| 3/2 | — | — | 0.146 | 9 | 0.5 |
| 3/3 | X | — | 0.106 | 9 | — |

[a]None detected even after concentrating the liquid sample 30 times (<0.4 ppm)
[b]No sample taken (—)

What is claimed is:

1. A process for preventing dissolution of a Group VIII noble metal catalyst from a conductive or semiconductive carrier in a corrosive or oxidatively active liquid environment, comprising polarizing the Group VIII noble metal surface on the conductive or semiconductive carrier so as to render the polarized Group VIII noble metal surface cathodic with respect to an anode placed in a reactor containing the corrosive or oxidatively active liquid environment.

2. The process of claim 1, wherein the corrosive environment is that used in the liquid phase catalytic reaction of hydrogen and oxygen to form hydrogen peroxide in a liquid capable of stabilizing the hydrogen peroxide thus produced against decomposition, the liquid containing water and at least one strong inorganic acid.

3. The process of claim 2, wherein the Group VIII noble metal catalyst is palladium.

4. The process of claim 2, wherein the conductive carrier is carbon.

5. The process of claim 2, wherein the corrosive environment is aqueous acetone.

6. The process of claim 2, wherein the strong inorganic acid is hydrochloric acid or sulfuric acid.

7. The process of claim 2, wherein the corrosive environment contains hydrochloric acid and sulfuric acid.

8. The process of claim 2, wherein the catalyst is palladium supported on carbon and the corrosive environment is aqueous acetone containing hydrochloric acid and sulfuric acid.

* * * * *